US005574759A

United States Patent [19]

Dietrich et al.

[11] Patent Number: 5,574,759

[45] Date of Patent: Nov. 12, 1996

[54] METHOD FOR DISMANTLING BULKY PARTS OF PRESSURE-VESSEL FITTINGS OF A NUCLEAR PLANT AND FOR RECEIVING THE DISMANTLED PARTS

[75] Inventors: Alban Dietrich, Hassloch; Michael Spicka, Hemsbach, both of Germany

[73] Assignee: ABB Reaktor GmbH, Mannheim, Germany

[21] Appl. No.: 573,726

[22] Filed: Dec. 18, 1995

[30] Foreign Application Priority Data

Dec. 16, 1994 [DE] Germany ..... 44 45 171.7

[51] Int. Cl.[6] ..... G21C 19/00; G21F 9/28

[52] U.S. Cl. ..... 376/260; 376/272

[58] Field of Search ..... 376/260, 272; 83/923, 930

[56] References Cited

U.S. PATENT DOCUMENTS 4,696,786 9/1987 Frizot et al. ..... 376/260
5,263,062 11/1993 Guigon et al. ..... 376/260
5,301,212 4/1994 Jacquier et al. ..... 376/260
5,394,448 2/1995 Guiroy et al. ..... 376/260

FOREIGN PATENT DOCUMENTS 500404 8/1992 European Pat. Off. .

*Primary Examiner*—Daniel D. Wasil

[57] ABSTRACT

A method for dismantling bulky parts of pressure-vessel fittings of a nuclear plant and for receiving the dismantled parts presents difficulties with regard to radiation-proof handling. In order to solve that problem, a dismantling container which is set down in a water tank is used. The fittings to be dismantled are introduced into the dismantling container. Furthermore, a receiving container for the dismantled parts is inserted into the dismantling container. A dismantling manipulator is supported on the flange of the dismantling container. When the receiving container is full, the dismantling manipulator is moved to the side, the receiving container is extracted and its contents are transferred to a transport container.

5 Claims, 4 Drawing Sheets

METHOD FOR DISMANTLING BULKY PARTS OF PRESSURE-VESSEL FITTINGS OF A NUCLEAR PLANT AND FOR RECEIVING THE DISMANTLED PARTS

BACKGROUND OF THE INVENTION

Field of the Invention

The invention relates to a method for dismantling bulky parts of pressure-vessel fittings of a nuclear plant and for storing the dismantled parts.

Such a method is known from Published European Patent Application 0 500 404 A1. In that method, fittings are inserted in a dismantling container which is disposed in a water tank. The fittings are dismantled into predeterminable sizes and introduced into a receiving container that is likewise disposed in the water tank through the use of a dismantling manipulator which can be fixed relative to the dismantling container. Each detached portion must be transported to the receiving container through the use of a lifting appliance, which results in transport distances that are too long and therefore time-consuming.

Pressure vessels of nuclear plants are equipped with so-called pressure-vessel fittings for the purpose of receiving fuel assemblies. One bulky part of the fittings is, for example, the core container which fills a large proportion of the pressure-vessel interior, so that when the activated and contaminated core container is exchanged, very large and, due to the shielding requirements, very heavy transport containers, are required for transporting that bulky part. In order to ensure that smaller transport containers can be used, it is necessary to dismantle the bulky parts through the use of known dismantling devices.

SUMMARY OF THE INVENTION:

It is accordingly an object of the invention to provide a method for dismantling bulky parts of pressure-vessel fittings of a nuclear plant and for receiving the dismantled parts, which overcomes the hereinafore-mentioned disadvantages of the heretofore-known methods of this general type and which preserves short transport distances while ensuring a radiation-proof handling and reception of the bulky parts before and after their dismantling.

With the foregoing and other objects in view there is provided, in accordance with the invention, a method for dismantling bulky parts of pressure-vessel fittings of a nuclear plant and for storing the dismantled parts, which comprises setting down a dismantling container for pressure-vessel fittings in a water tank; inserting the pressure-vessel fittings into the dismantling container; introducing a receiving container for the dismantled parts into the dismantling container; fixing a dismantling manipulator relative to the dismantling container; separating the pressure-vessel fittings into predeterminable smaller-size parts; introducing the smaller-size parts into the receiving container; removing the receiving container from the dismantling container; and transferring the parts disposed within the receiving container, within the nuclear plant, into a transport container.

Thus, the pressure-vessel fittings to be dismantled are inserted into the dismantling container. The dismantling device is fixed in the immediate vicinity of the dismantling container or to the dismantling container itself. The receiving container for the dismantling products is disposed within the dismantling container, so that short distances have to be covered from dismantling to storage. As soon as the receiving container is filled with dismantled portions, it is inserted into a transport container.

The proposed measures ensure intermediately storable or, if required, ultimately storable conditioning as early as within the nuclear plant, with the dismantling and storage operations taking place in a very confined space.

In accordance with another mode of the invention, there is provided a method which comprises setting down a bottom part of the dismantling container in the water tank; inserting the pressure-vessel fittings to be dismantled into the bottom part; and pushing a casing part of the dismantling container over the pressure-vessel fittings like a sleeve, and releasably connecting the casing part to the bottom part.

In accordance with a further mode of the invention, there is provided a method which comprises introducing the receiving container into a shielding container within the water tank and transferring the receiving container from the shielding container into the transport container outside the water tank.

In accordance with an added mode of the invention, there is provided a method which comprises inserting the shielding container together with the receiving container disposed in it, into the transport container.

In accordance with a concomitant mode of the invention, there is provided a method which comprises bringing the shielding container and the transport container into position axially-parallel one above the other, removing at least one of a bottom and a cover of the mutually adjacent containers, and passing the receiving container from the shielding container into the transport container with a lifting appliance.

Thus, to guarantee a sufficient water covering, a dismantling container being formed of a bottom part and a casing part is used, with the components to be dismantled being moved in from the side before the casing part is pushed over the component in a sleeve-like manner.

Radiation-proof handling is also served by the measure calling for the filled receiving container to be introduced into a shielding container as early as within the dismantling container. The receiving container can then be transferred from the shielding container into a transport container outside the water tank. It is also possible to use the shielding container directly, thereby making it possible to employ a thin-walled and therefore light-weight transport container.

Other features which are considered as characteristic for the invention are set forth in the appended claims.

Although the invention is illustrated and described herein as embodied in a method for dismantling bulky parts of pressure-vessel fittings of a nuclear plant and for receiving the dismantled parts, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
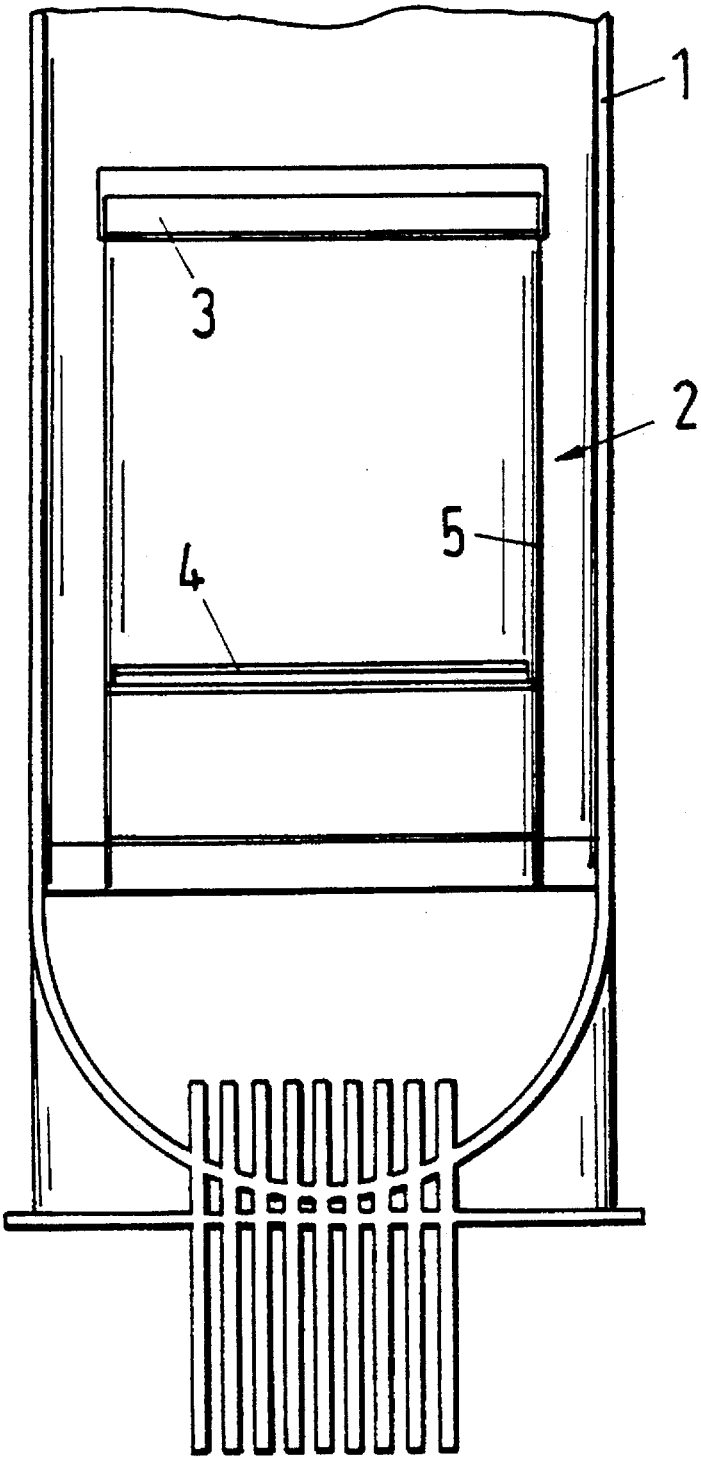
FIG. 1 is a fragmentary, diagrammatic, longitudinal-sectional view of a reactor pressure vessel with pressure-vessel fittings.

Referring now to the figures of the drawing in detail and first, particularly, to FIG. 1 thereof, there is seen a sub-region of a reactor pressure vessel 1 with a particularly bulky part of pressure-vessel fittings 2. The method according to the invention is to be described with reference to this bulky part, which is formed of upper and lower core grids 3, 4 and a core shroud 5. As a rule, between the core grids 3, 4 and the core shroud 5 there is a screw connection which is released as early as during removal from the reactor pressure vessel, so that three individual parts are available for dismantling. However, the method can also be employed when, for example, a welded structure is present and the core grids 3, 4 and the core shroud 5 form a single part.

Figure 2:
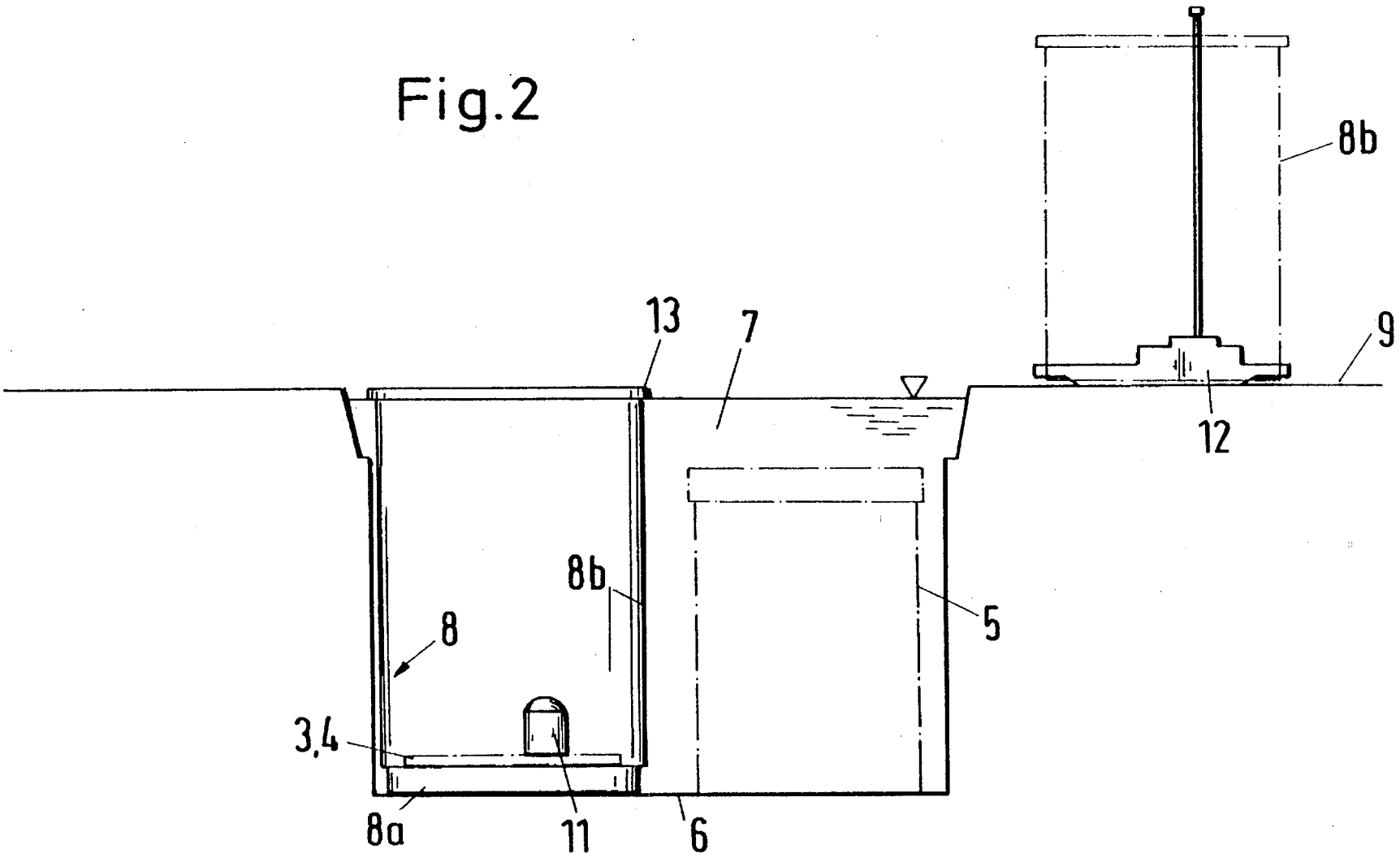
FIG. 2 is a longitudinal-sectional view of a dismantling station in a specific state of the method.
Figure 3:
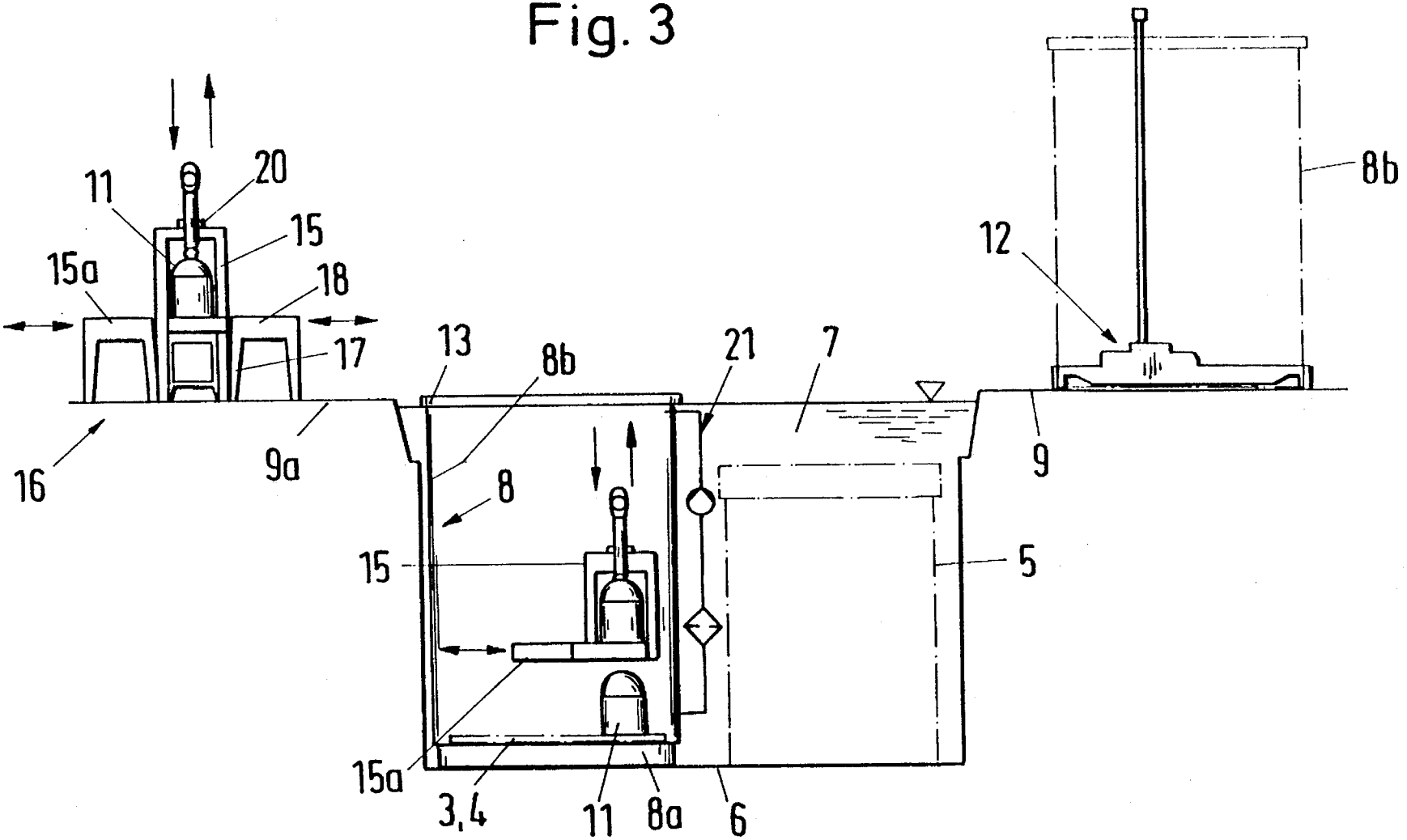
FIGS. 3 and 4 are views similar to FIG. 2, in each case showing another state of the method.
Figure 4:
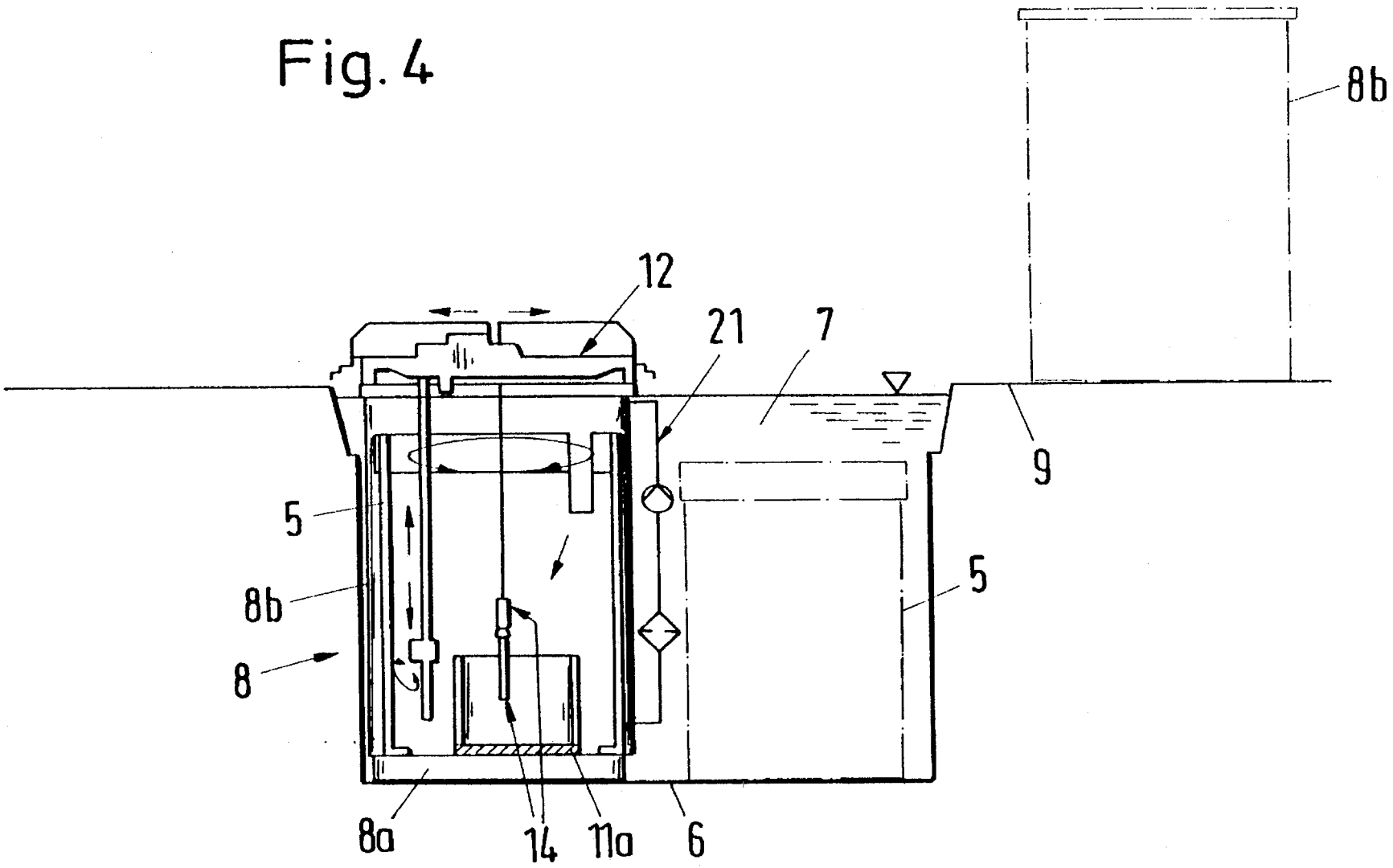

After being removed from the reactor pressure vessel 1, the core grids 3 and 4 and the core shroud 5 are set down on a bottom 6 of a water tank 7, as is indicated by the core shroud 5 in dot-dash lines in FIGS. 2 to 4.

According to FIG. 2, a bottom part 8*a* of a dismantling container 8 is set down on the bottom 6 and one of the core grids 3, 4 is laid onto the bottom part 8 *a*. A casing 8 *b* of the dismantling container which is set down on a tank edge 9 is moved into the water tank 7 through the use of a non-illustrated lifting appliance and is connected to the bottom part 8*a* to form the dismantling container 8, as is also seen in FIGS. 3 and 4. A receiving container 11 for receiving parts obtained during subsequent dismantling is disposed on the core grid. A dismantling manipulator 12 that is likewise set down on the tank edge 9 is set down on a flange 13 of the dismantling container 8 through the use of the non-illustrated lifting appliance or through a likewise non-illustrated rail connection and is fixed relative to the dismantling container, as is shown in FIG. 4.

When this phase for dismantling a core grid 3, 4 according to FIG. 2 is reached, a separation of the core grid into transportable parts is carried out by the dismantling manipulator, for example by plasma cutting, with the parts being deposited in the receiving container 11 through the use of an auxiliary lifting appliance 14 that is seen in FIG. 4 and is assigned to the dismantling manipulator 12. After the receiving container 11 is filled, the dismantling manipulator 12 is brought into its set-down position on the tank edge 9.

According to FIG. 3, a shielding container 15 is introduced into the water tank 7, its bottom part 15 *a* is removed, the receiving container 11 is drawn into the shielding container 15 and the bottom part 15 *a* is reattached. The shielding container 15 that is loaded with the receiving container 11 is brought to a transfer station 16 stationed on a tank edge 9 *a*. A transport container 17, which is constructed as an ultimate-storage container and has a cover 18 that is removed, is already disposed there. The shielding container 15 is set down on the transport container 17 in alignment in the axial direction, and its bottom part 15 *a* is moved away laterally, so that the receiving container 11 is lowered into the transport container 17 by a lifting device 20. The shielding container 15 is closed through the use of its bottom part 15 *a* and is set down at a suitable point until it is next used.

After the receiving container 11 has been loaded several times, as soon as the core grids 3, 4 are dismantled, extracted and stored in a radiation-proof manner, the dismantling of the core shroud 5 is dealt with according to FIG. 4. In this case as well, the procedure according to FIG. 2 is carried out analogously, with the core-container shroud 5 and a receiving container 11*a* being set down on the bottom part 8*a* after the bottom part 8*a* has been put in place. The dismantling-container casing 8 *b* is then lowered in a sleeve-like manner over the core shroud 5 and is connected to the bottom part 8*a* to form the dismantling container 8. The dismantling manipulator is then supported on the flange of the dismantling container 8 and the dismantling of the core shroud 5 commences according to FIG. 4. Segments which are detached in each case during this dismantling are inserted into the container 11 *a* through the use of the auxiliary lifting appliance. After the container 11 *a* is filled, the dismantling manipulator is brought to its set-down point on the tank edge 9 and the load of the receiving container 11 *a* is transferred to a transport container 17 correspondingly to FIG. 3. In another embodiment, the receiving container 11 *a*, together with its load, can also be placed directly into a transport container. The water of the dismantling container 8 is purified through the use of a circulating system 21.

We claim:

1. A method for dismantling bulky parts of pressure-vessel fittings of a nuclear plant and for storing the dismantled parts, which comprises:

setting down a dismantling container for pressure-vessel fittings in a water tank;

inserting the pressure-vessel fittings into the dismantling container;

introducing a receiving container for the dismantled parts into the dismantling container;

fixing a dismantling manipulator relative to the dismantling container;

separating the pressure-vessel fittings into predeterminable smaller-size parts;

introducing the smaller-size parts into the receiving container;

removing the receiving container from the dismantling container; and transferring the parts disposed within the receiving container, within the nuclear plant, into a transport container.

2. The method according to claim 1, which comprises:

setting down a bottom part of the dismantling container in the water tank;

inserting the pressure-vessel fittings to be dismantled into the bottom part; and pushing a casing part of the dismantling container over the pressure-vessel fittings like a sleeve, and releasably connecting the casing part to the bottom part.

3. The method according to claim 1, which comprises introducing the receiving container into a shielding container within the water tank and transferring the receiving container from the shielding container into the transport container outside the water tank.

4. The method according to claim 1, which comprises inserting a shielding container together with the receiving container disposed in it, into the transport container.

5. The method according to claim 3, which comprises bringing the shielding container and the transport container into position axially-parallel one above the other, removing at least one of a bottom and a cover of the mutually adjacent containers, and passing the receiving container from the shielding container into the transport container with a lifting appliance.

* * * * *